US010858829B2

(12) United States Patent
Rapposelli et al.

(10) Patent No.: US 10,858,829 B2
(45) Date of Patent: Dec. 8, 2020

(54) VENTED SUSPENSION CEILING BEAM AND SUSPENSION CEILING SYSTEM

(71) Applicant: CertainTeed Ceilings Corporation, Malvern, PA (US)

(72) Inventors: Matthew Rapposelli, Malvern, PA (US); Robin C. Czyzewicz, Wilmington, DE (US); Isabelle Etchart Randlett, Malvern, PA (US); Michael J. Lembo, Souderton, PA (US); David E. Woolley, Pittsburgh, PA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 0 days.

(21) Appl. No.: 16/368,234

(22) Filed: Mar. 28, 2019

(65) Prior Publication Data

US 2019/0323233 A1 Oct. 24, 2019

Related U.S. Application Data

(60) Provisional application No. 62/651,092, filed on Mar. 31, 2018.

(51) Int. Cl.
*E04B 9/02* (2006.01)
*E04B 9/06* (2006.01)

(52) U.S. Cl.
CPC ..... *E04B 9/02* (2013.01); *E04B 9/068* (2013.01); *E04B 2009/026* (2013.01)

(58) Field of Classification Search
CPC ..... E04B 9/02; E04B 9/068; E04B 2009/026
See application file for complete search history.

(56) References Cited

U.S. PATENT DOCUMENTS 2,859,681 A * 11/1958 Rachlin ..... F24F 13/072 454/297
3,101,661 A 8/1963 Bibb
3,252,399 A * 5/1966 Olson ..... E04B 9/02 454/298
3,444,800 A * 5/1969 Nelsson ..... E04B 9/02 454/298
3,475,869 A * 11/1969 Jahn ..... E04B 9/068 52/506.07
3,584,565 A 6/1971 Bush
(Continued)

FOREIGN PATENT DOCUMENTS

EP 2378023 A1 10/2011
KR 1991-0002420 Y1 4/1991
WO 2018053136 A1 3/2018

OTHER PUBLICATIONS

International Search Report and Written Opinion in International Patent Application PCT/US2019/024656 dated Aug. 5, 2019.

*Primary Examiner* — Paola Agudelo
(74) *Attorney, Agent, or Firm* — McDonnell Boehnen Hulbert & Berghoff LLP

(57) ABSTRACT

The present disclosure relates generally to suspension ceiling grids, for example, suitable for holding a suspension ceiling composed of ceiling tiles. The present disclosure relates more particularly to a vented suspension ceiling support beam including an elongate body extending in a longitudinal direction. The body includes a vertical web, and opposing first and second flanges protruding laterally from the vertical web. A vent is formed through the first flange.

17 Claims, 13 Drawing Sheets

(56) References Cited

U.S. PATENT DOCUMENTS

| | | | | | |
|---|---|---|---|---|---|
| 3,601,033 | A * | 8/1971 | Lambert | E04B 9/02 | 454/292 |
| 3,848,385 | A | 11/1974 | Thompson | | |
| 4,535,580 | A * | 8/1985 | Shirey | E04B 9/10 | 52/506.06 |
| 4,542,615 | A * | 9/1985 | McCall | E04B 9/006 | 52/506.07 |
| 4,712,350 | A * | 12/1987 | Vukmanic | E04B 9/241 | 52/506.07 |
| 6,405,543 | B2 * | 6/2002 | Kopko | F24F 3/14 | 62/89 |
| 7,712,274 | B2 * | 5/2010 | Wendt | E04B 9/003 | 52/377 |
| 9,328,510 | B1 * | 5/2016 | Springer | E04B 9/241 | |
| 2003/0213853 | A1 * | 11/2003 | Demster | E04B 9/02 | 236/49.3 |
| 2018/0135300 | A1 * | 5/2018 | Czyzewicz | E04B 9/067 | |
| 2019/0186133 | A1 * | 6/2019 | Scherrer | E04B 9/303 | |

* cited by examiner

VENTED SUSPENSION CEILING BEAM AND SUSPENSION CEILING SYSTEM

CROSS-REFERENCE TO RELATED APPLICATIONS

This application claims the benefit of priority of U.S. Provisional Patent Application No. 62/651,092, filed Mar. 31, 2018, which is hereby incorporated by reference herein in its entirety.

BACKGROUND OF THE DISCLOSURE

1. Field of the Disclosure

The present disclosure relates generally to suspension ceiling grids, for example, suitable for holding a suspension ceiling composed of ceiling tiles. The present disclosure relates more particularly to a suspension ceiling grid forming part of a ventilation system.

2. Technical Background

Suspension grids that hold up acoustic ceiling tiles, lighting fixtures, or other tiles or panels are effective for constructing an attractive and convenient ceiling. The suspension grid allows the builder to provide a clean and uninterrupted boundary to the space below the ceiling while hiding infrastructure such as structural members, heating, ventilation and air conditioning (HVAC) components, wiring, and plumbing in a plenum space above the ceiling. Further, suspension ceilings provide the benefit of being modular. If works needs to be done above the ceiling, a small portion can be temporarily removed to provide access above the ceiling. Likewise, if any portion of the ceiling is damaged, that portion can be replaced without deconstructing the entire ceiling.

When the plenum space is used to house HVAC components above the suspension ceiling, the HVAC components need fluid access to the underlying living or working space. In conventional systems, vents or diffusers are provided in the ceiling that provide air to or receive air from the underlying space. In some cases, these vents or diffusers replace an entire acoustic ceiling tile in the ceiling system. But such a large vent is considered unattractive and not cohesive with the rest of the ceiling.

Alternative solutions use more subtle diffusers that do not cover the space of an entire ceiling tile. However, these diffusers still provide an inconsistency in the visual of the ceiling. Moreover, installing such diffusers can be complicated. Often the ceiling grid is customized in certain areas to accommodate the diffuser, which may require cutting the ceiling grid beams, cutting the ceiling tiles, or both.

The present inventors have recognized that a system providing ventilation without interrupting the pattern or visual of the ceiling and that is uncomplicated to install would be attractive to builders and designers.

SUMMARY OF THE DISCLOSURE

In one aspect, the present disclosure provides a vented support beam for a suspension ceiling comprising:

- an elongate body extending in a longitudinal direction, the body including:
  - a vertical web, and
  - opposing first and second flanges protruding laterally from the vertical web; and

- a vent formed through the first flange.

In another aspect, the disclosure provides a suspension ceiling ventilation system comprising:

- a plurality of support beams arranged in a ceiling grid so as to form a plurality of grid openings in the ceiling grid, each of the support beams including a vertical web and opposing flanges protruding laterally from the vertical web, wherein at least a portion of the plurality of support beams are vented support beams comprising:
  - an elongate body extending in a longitudinal direction, the body including a vertical web and opposing first and second flanges protruding laterally from the vertical web, and
  - a vent through the first flange; and
- a plurality of ceiling tiles, each of the ceiling tiles disposed in a respective grid opening of the ceiling grid so as to form a suspension ceiling,
- wherein the suspension ceiling provides a plenum space above the ceiling and an underlying space below the ceiling.

In another aspect, the disclosure provides a method of constructing a suspension ceiling ventilation system, the method comprising:

- arranging a plurality of support beams in a ceiling grid that is coupled to a support structure, wherein the ceiling grid includes a plurality of grid openings between the support beams, each of the support beams including a vertical web and opposing flanges protruding laterally from the vertical web, wherein at least a portion of the plurality of support beams are vented support beams;
- positioning each of a plurality of ceiling tiles in a respective grid opening of the ceiling grid so as to form a suspension ceiling, wherein the suspension ceiling provides a plenum space above the ceiling and an underlying space below the ceiling.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional ventilation systems interrupt the pattern and visual of the ceiling surface. The present inventors have developed a suspension ceiling support beam and ventilation system that avoids the need to interrupt the ceiling surface and avoids the need for complicated installation methods.

Figure 1:
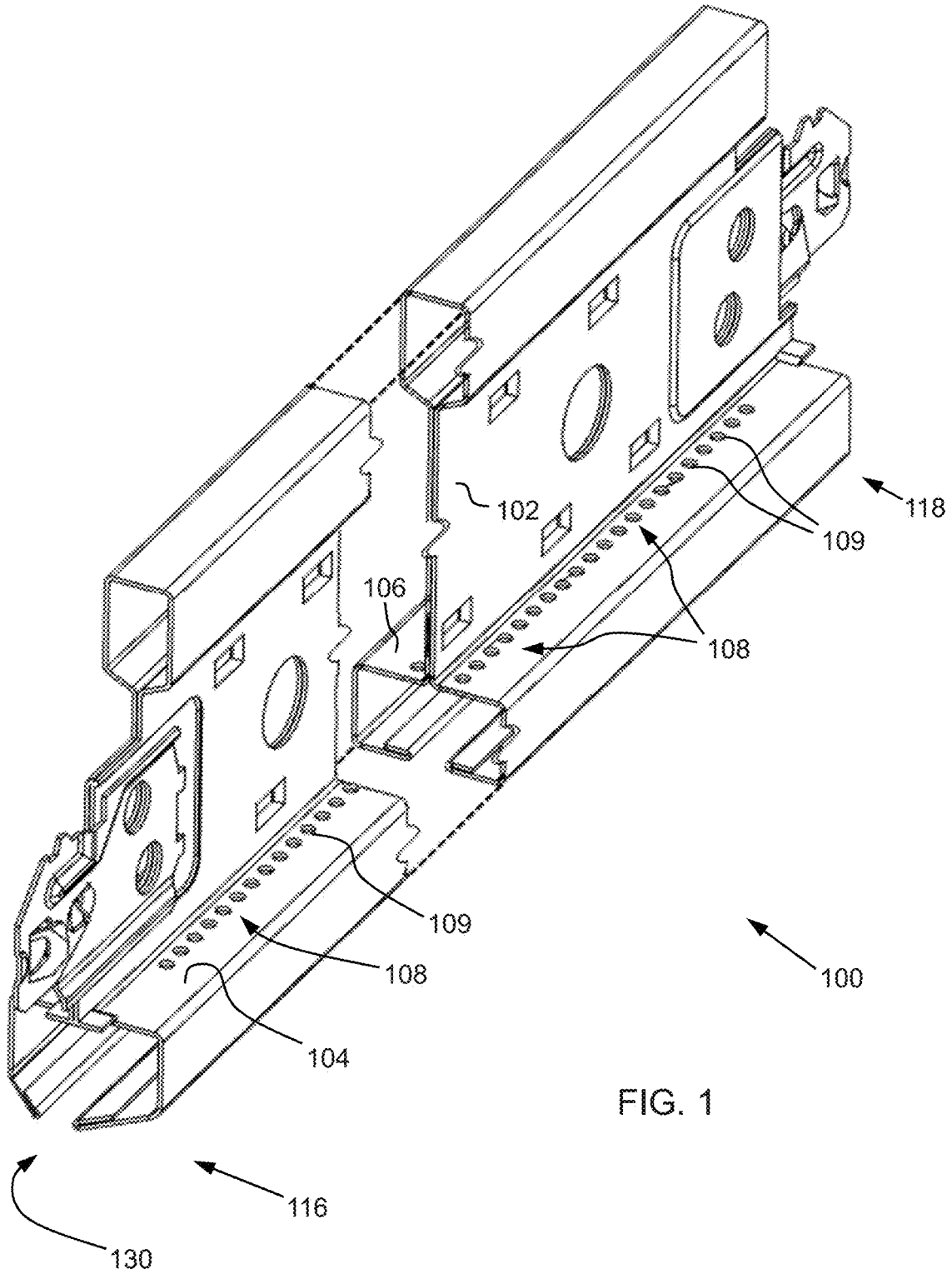
FIG. 1 is a schematic perspective view of a vented support beam in accordance with an embodiment of the disclosure.
Figure 2:
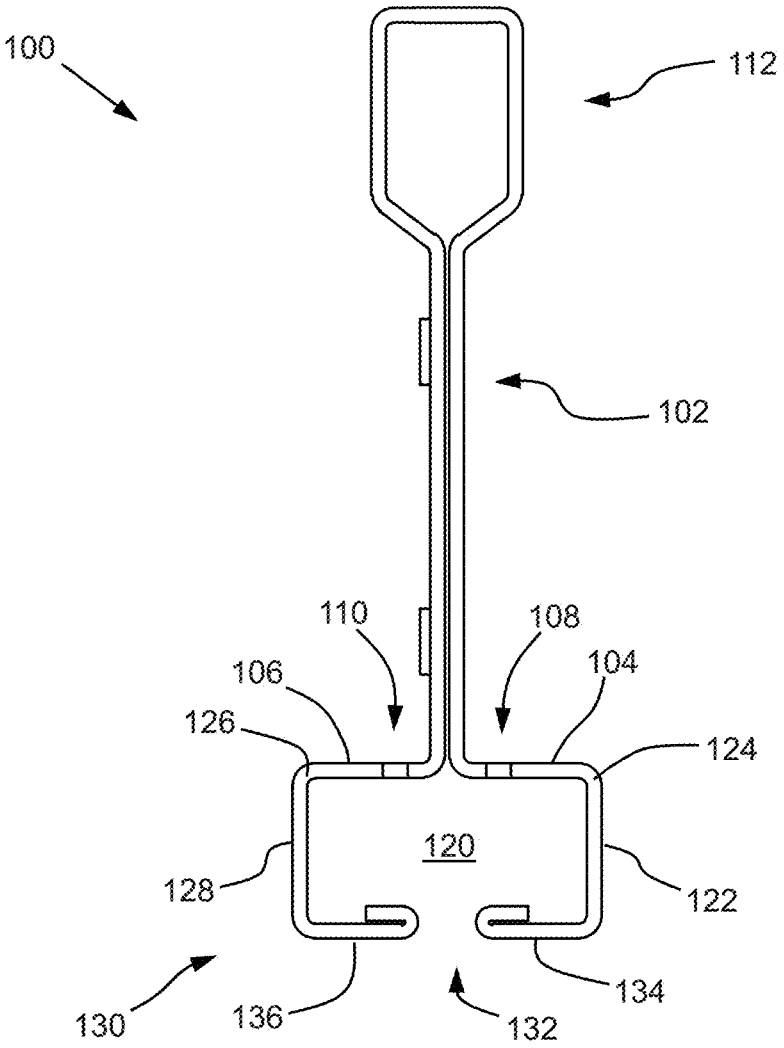
FIG. 2 is a schematic cross-sectional side view of the vented support beam of FIG. 1.

Accordingly, one aspect of the disclosure is a vented support beam for a suspension ceiling including an elongate body extending in a longitudinal direction, the body including a vertical web and opposing first and second flanges protruding laterally from the vertical web. The vented support beam also including a vent formed through the first flange. Such a vented support beam is shown in perspective view in FIG. 1. Vented support beam 100 includes a vertical web 102 and two flanges 104, 106 protruding laterally from the web 102. First flange 104 is disposed on one side of web 102 and second flange 106 is disposed on the other. A first vent 108 extends through the first flange 104 providing fluid communication between a space above first flange 104 and a space below the flange.

In certain embodiments as otherwise described herein, the vented support beam further comprises another vent formed through the second flange. For example, vented support beam 100 includes a second vent 110 formed through second flange 106, like first vent 108, second vent 110 provides fluid communication between a space above and a space below second flange 106.

In certain embodiments as otherwise described herein, a width of the beam is in a range from ¼ inch to 2 inches, e.g., from ⅜ to 1½ inches, e.g., from ½ inch to 1 inch. Further, in certain embodiments as otherwise described herein, a height of the beam is in a range from 1 inch to 3 inches, e.g., from 1½ inches to 2 inches. Vented support beam 100 has a width of 9/16 of an inch and a height of 1¾ inches. The width of vented support beam 100 is governed by the lateral extent of the first and second flanges 104, 106, which form the widest part of vented support beam 100. In other embodiments, other components of the vented support beam may form the widest part of the support beam. The height of vented support beam 100 extends from a bulb 112 disposed at the upper end of the beam and a box profile 130 disposed at the lower end of the vented support beam 100, both of which are described in more detail below.

In certain embodiments as otherwise described herein, the vent extends at least 6 inches in the longitudinal direction, e.g., at least 12 inches, e.g., at least 20 inches. For example, in vented support beam 100, vent 108 in first flange 104 extends from a first end 116 of the vented support beam to a second end 118. In other embodiments, the vent spans a smaller portion of the length of the vented support beam. Still in other embodiments, several vents are provided in a series along the length of the first flange.

In certain embodiments as otherwise described herein, the vent includes a plurality of holes disposed in a line along the longitudinal direction. For example, vent 108 includes a plurality of circular holes 109 disposed in a line that runs along a side of support web 102. In other embodiments, the holes may have various other shapes, as will be appreciated by the person of ordinary skill in the art.

The term vent, as used herein, refers to a single aperture or several apertures that are in close proximity to one another. For example, a vent may be formed along the longitudinal direction by several holes where the distance between two of the holes is no more than twice the length of the opening in the longitudinal direction. As the term vent is used herein, holes separated by more than this distance along the longitudinal direction constitute separate vents.

Figure 3:
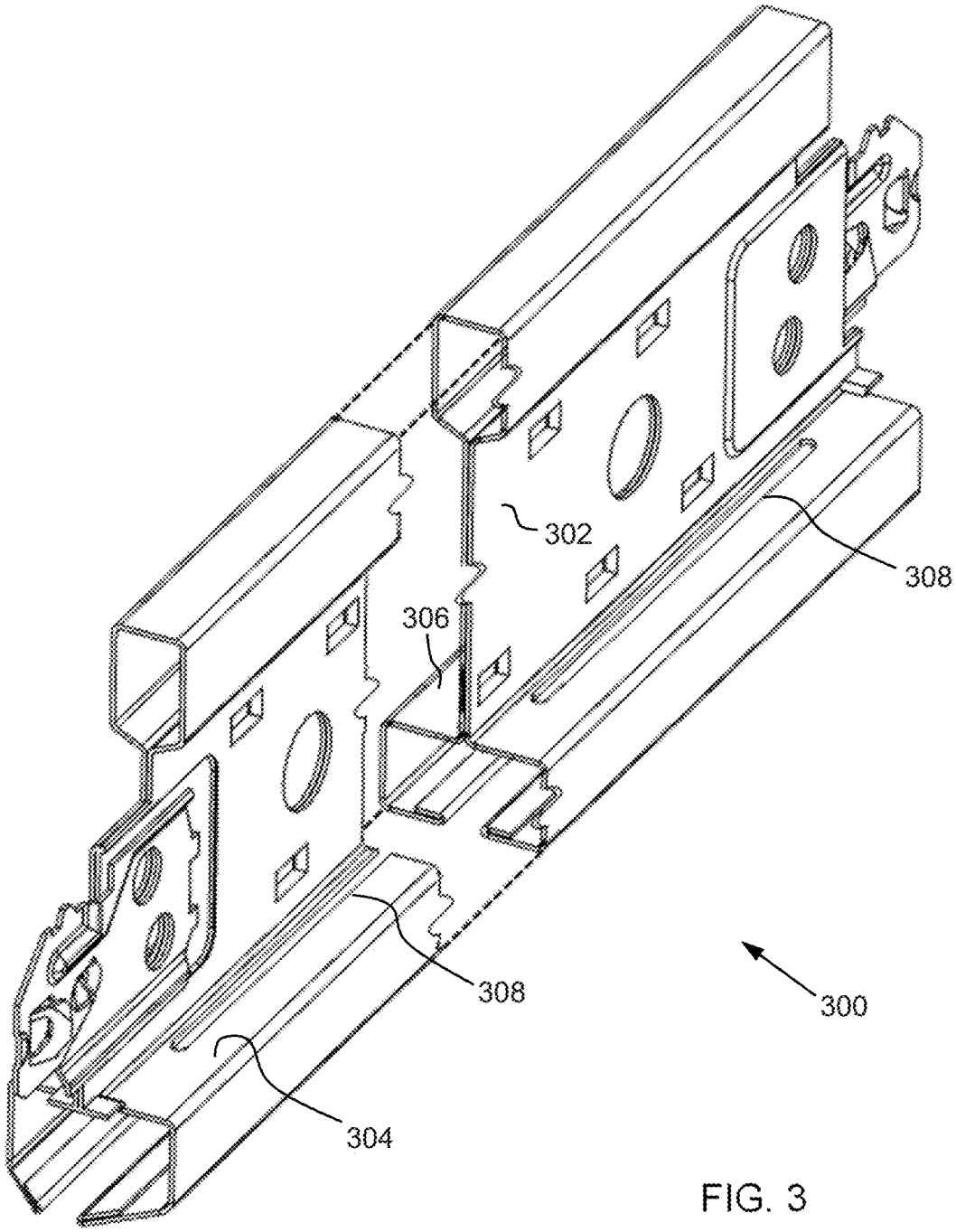
FIG. 3 is a schematic perspective view of a vented support beam in accordance with another embodiment of the disclosure.

In certain embodiments as otherwise described herein, the vent includes a slot extending along the longitudinal direction. A vented support beam including such a vent is shown in FIG. 3. Similar to vented support beam 100, vented support beam 300 includes a support web 302 and first and second flanges 304, 306 protruding laterally therefrom. Further, two vents 308 are provided in first flange 304. One vent 308 is disposed at one end of vented support beam 300 and another vent 308 is disposed at the other end. In some embodiments, additional vents are provided along the length of the vented support beam. Vent 308 is formed as a slot that extends in the longitudinal direction. While vents 308 have rounded ends, in other embodiments, the openings forming the vents may have other shapes.

In certain embodiments as otherwise described herein, the vented support beam further comprises a channel disposed adjacent to the first and second flanges, where the channel is in fluid communication with the vent. In certain embodiments as otherwise described herein, the channel is formed by a first side wall projecting down from an outer edge of the first flange and a second side wall projecting down from an outer edge of the second flange. For example, vented support beam 100 includes a channel 120 that is adjacent to and in fluid communication with vent 108. Accordingly, vent 108 provides fluid access between channel 120 and the space above first flange 104. Channel 120 is formed by the first and second flanges 104, 106 in combination with first side wall 122 and second side wall 128. First sidewall 122 projects down from an outer edge 124 of first flange 104 and second sidewall 128 similarly projects down from an outer edge 126 of second flange 106. As a result, the sidewalls 122, 128 and flanges 104, 106 provide an enclosed space that forms channel 120.

In certain embodiments as otherwise described herein, the channel is enclosed in a box profile disposed below the first and second flanges. In certain embodiments as otherwise described herein, the box profile includes a slot opposite the first and second flanges, where the slot extends in the longitudinal direction. For example, in vented support beam 100, channel 120 is provided in a box profile 130 taking the form of an architectural feature of a bolt slot ceiling grid beam. In particular, box profile 130 includes a slot 132 positioned at the lower end thereof opposite the first and second flanges 104, 106. The combination of vent 108 through first flange 104 at the top of box profile 130 and the slot 132 at the bottom of box profile 130 allows air to pass through the channel 120 from above the vented support beam 100 to below the beam or vice versa. The inclusion of this fluid path through the box profile 130 of vented support beam 100 allows the ventilation system to utilize a fluid path in a concealed location, as explained in more detail below.

Figure 4:
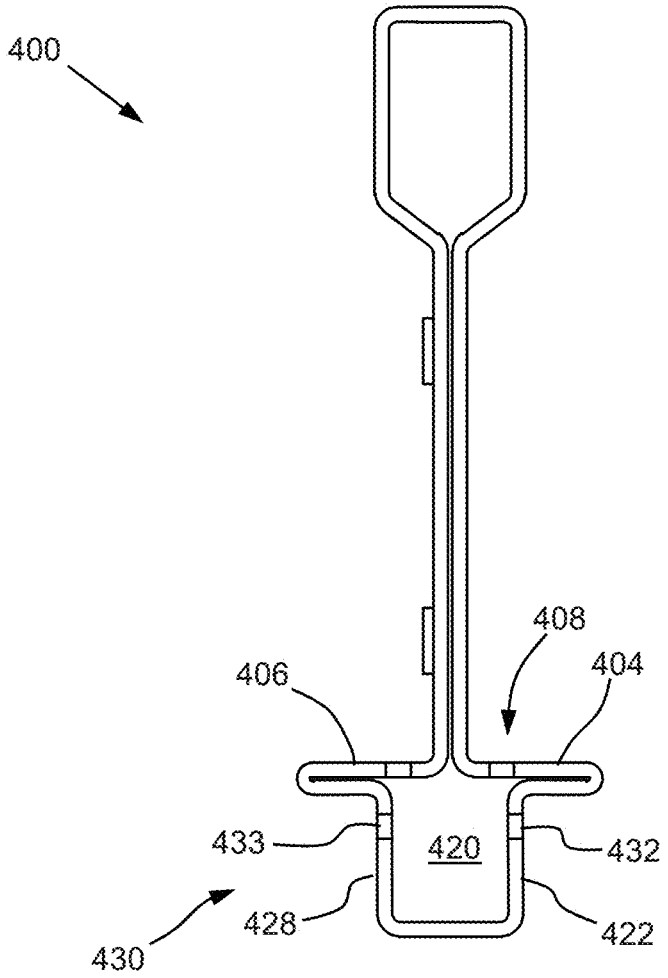
FIG. 4 is a schematic cross-sectional side view of a vented support beam in accordance with another embodiment of the disclosure.

While box profile 130 of vented support beam 100 takes the form of an architectural feature of a bolt slot beam, in other embodiments, the box profile has a different shape. For example, vented support beam 400, shown in FIG. 4, includes a channel 420 that is disposed within box profile 430. The box profile 430 is in the form of a narrow bulb disposed beneath first and second flanges 404 and 406. Similar to the channel of vented support beam 100, channel 420 is in fluid communication with vent 408 passing through first flange 404. However, fluid access out of box profile 430 is provided by openings 432, 433 in the sidewalls 422, 428 of the box profile 430, rather than a slot at the bottom of the box profile.

Figure 5:
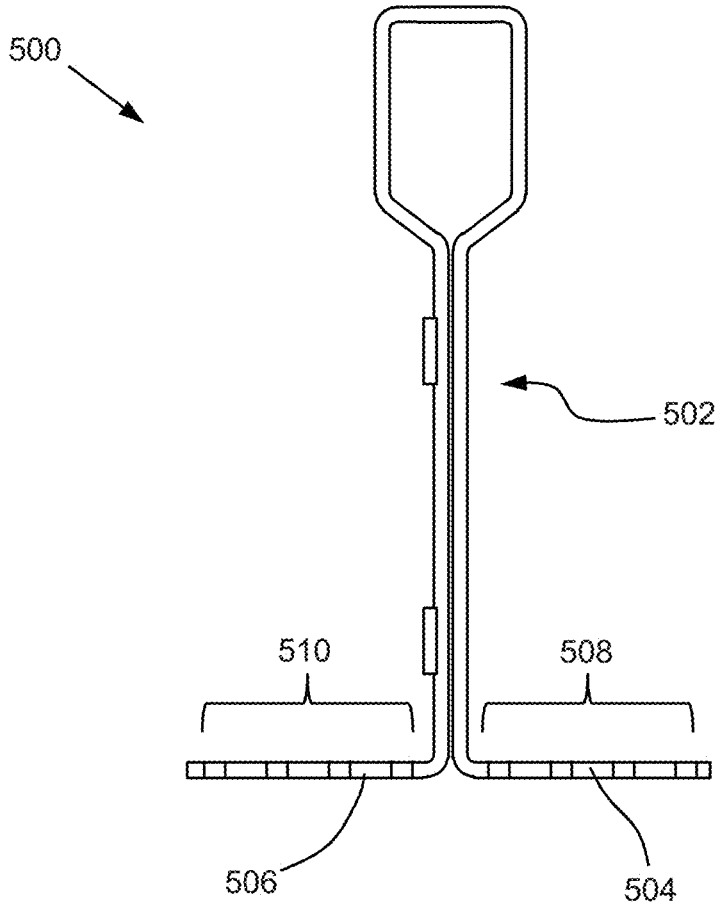
FIG. 5 is a schematic cross-sectional side view of a vented support beam in accordance with another embodiment of the disclosure.

In certain embodiments as otherwise described herein, the vented support beam is in the form of a T-beam. For example, vented support beam 500, shown in FIG. 5, includes first and second flanges 504, 506 that protrude laterally from a web 502. Each of the first and second flanges 504, 506 includes a respective vent 508, 510 in the form of several rows of holes extending through the flanges.

In certain embodiments as otherwise described herein, the beam has a box profile that includes a first sidewall, a second sidewall, a first lip connected to the first sidewall that borders the slot, and a second lip connected to the second sidewall that borders the slot. For example, the box profile 130 of vented support beam 100 includes a includes a first lip 134 extending inward from first sidewall 122 and a second lip 136 extending inward from second sidewall 128 toward first lip 134. Slot 132 is formed between the inner ends of first lip 134 and second lip 136.

In certain embodiments as otherwise described herein, the vented support beam is formed of a cut and shaped metal sheet. In some embodiments, the vented support beam is formed from a single metal sheet that is bent and cut into the shape of the beam. The term metal sheet, as used herein, is not limited to any particular thickness and may include materials conventionally referred to as metal foil, sheet metal, metal plate or metal strips. In certain embodiments, the vented support beam is formed of steel or aluminum. In other embodiments, the vented support beam is a polymer beam. In some embodiments the polymer beam is extruded, molded, or a combination thereof.

In certain embodiments as otherwise described therein, the web includes adjacent first and second support walls, and wherein the vent is disposed laterally outside of the first and second support walls. For example, vented support beam 100 includes a double-walled web 102 including a first support wall 140 and a second support wall 142. The two support walls 140, 142 are formed from a single metal sheet that is folded back on itself to form the double-walled web.

In certain embodiments as otherwise described herein, an inner surface of the first support wall abuts an inner surface of the second support wall. For example, first and second support walls 140, 142 are immediately adjacent such that the neighboring surfaces of the support walls abut one another. In some embodiments, the support walls are stitched to one another. For example, along the length of web 102 indentations 144 are made that deform both support walls 140, 142 forming a connection between the walls and strengthening the web 102.

In certain embodiments as otherwise described herein, the vented support beam further includes a bulb attached to an upper end of the web, and the first and second flanges are disposed at a lower end of the web. For example, the metal sheet that forms the two support walls 140, 142 is looped at the top of vented support beam 100 in the form of a bulb 112. The widened bulb strengthens the beam and improves bending resistance. At the lower end of web 102, the metal sheet is bent outward to form the opposing webs 104, 106. The metal sheet continues around the box profile 130 and ends with respective hems at the inner ends of lips 134, 136.

In some embodiments, the vented support beam includes a clip for attaching the beam to neighboring components of a ceiling grid. For example, each of the first and second ends 116, 118 of vented support beam 100 includes a clip 144 configured to attach vented support beam 100 to a receiving space in the center of another beam or to the end of another beam. In particular, clip 144 can be attached to a similar clip extending in the same direction as vented support beam 100, both of which are held in a receiving space in the middle of a third beam.

Figure 6:
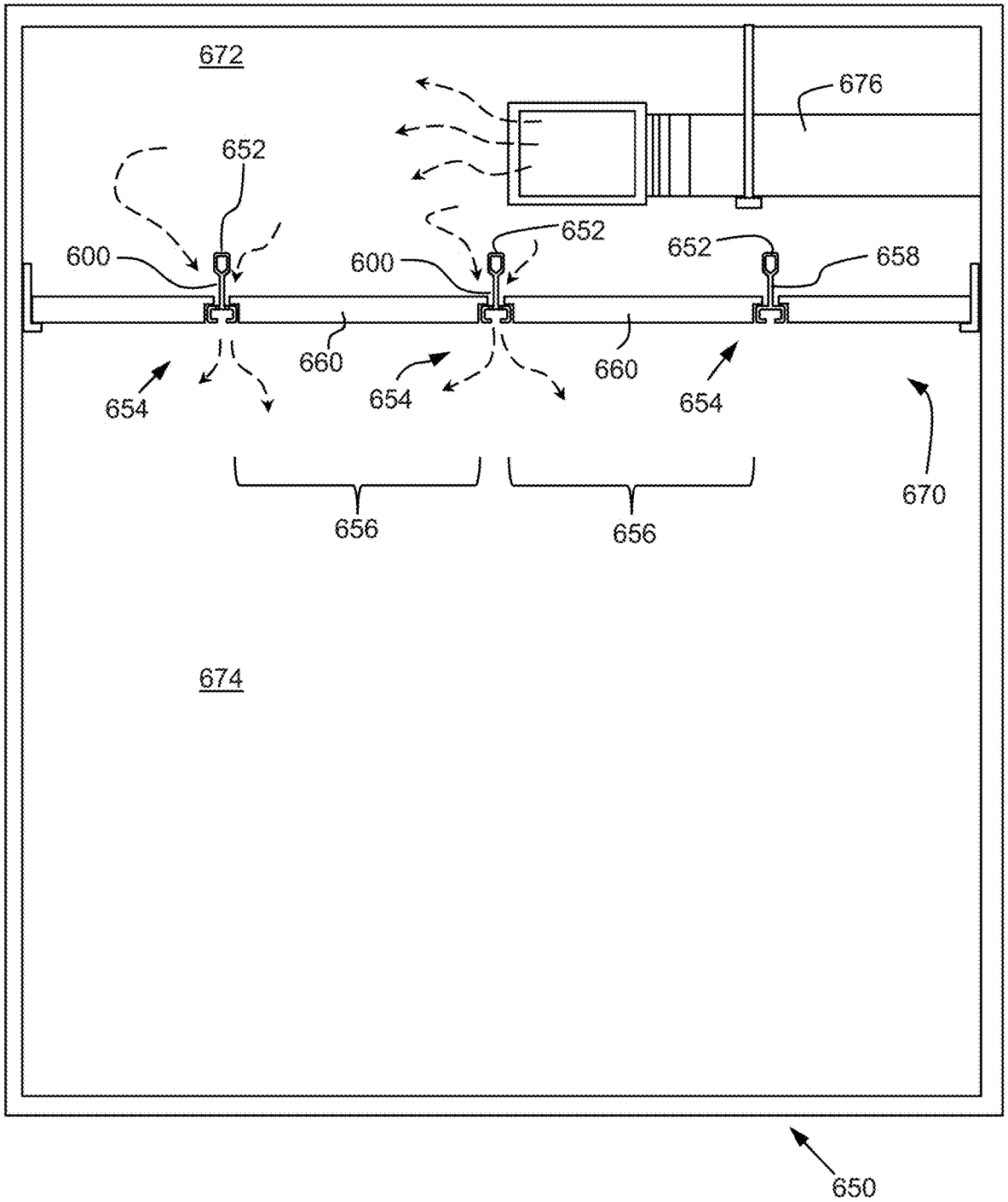
FIG. 6 is a schematic cross-sectional side view of a suspension ceiling ventilation system in accordance with an embodiment of the disclosure.

In another aspect, the disclosure provides a suspension ceiling ventilation system including a plurality of support beams arranged in a ceiling grid so as to form a plurality of grid openings in the ceiling grid. Each of the support beams includes a vertical web and opposing flanges protruding laterally from the vertical web. At least a portion of the plurality of support beams are vented support beams according to any of the embodiments set forth above. The system further comprises a plurality of ceiling tiles, where each of the ceiling tiles is disposed in a respective grid opening of the ceiling grid so as to form a suspension ceiling. The suspension ceiling provides a plenum space above the ceiling and an underlying space below the ceiling. A portion of such a suspension ceiling ventilation system is schematically depicted in FIG. 6. System 650 includes a plurality of support beams 652 that are arranged in a ceiling grid 654 in a manner that forms a plurality of openings 656. FIG. 6 is a cross section where only three of the support beams 652 are visible. However, ceiling grid 654 includes further support beams that run perpendicular to support beams 652.

Each of the support beams 652 in ceiling grid 654 has a similar configuration to that of vented support beam 100 and includes a double-walled vertical web, opposing flanges that protrude laterally from the web and establish a box profile at the lower end of the web, and a bulb at the upper end of the web. Indeed, a portion of the support beams 652 in ceiling grid 654 are vented support beams 600 that are identical to vented support beam 100. The remaining support beams 652 are similar to the vented support beam 600, differing only in that they do not include a vent. FIG. 6 shows two vented support beams 600 and one non-vented support beam 658.

System 650 further includes a plurality of ceiling tiles 660 disposed in the grid openings 656 formed in ceiling grid 654. The combination of the ceiling tiles 660 and ceiling grid 654 forms a suspension ceiling 670 that provides a plenum space 672 above the suspension ceiling and an underlying space 674 below the ceiling.

Each of the grid openings has a width and a breadth for holding a respective ceiling tile. As used herein, the term grid opening refers to the standardized openings in the middle of the grid, and not to the openings at the perimeter of the grid, which may be sized differently, and are described further below. In certain embodiments as otherwise described herein, each of the grid openings has a width is in a range of 20 to 30 inches, e.g., 23 to 25 inches. In certain embodiments, each grid opening has a breadth in a range of 20 to 60 inches, e.g., a breadth in a range of 20 to 30 inches, e.g., 23 to 25 inches.

Figure 7:
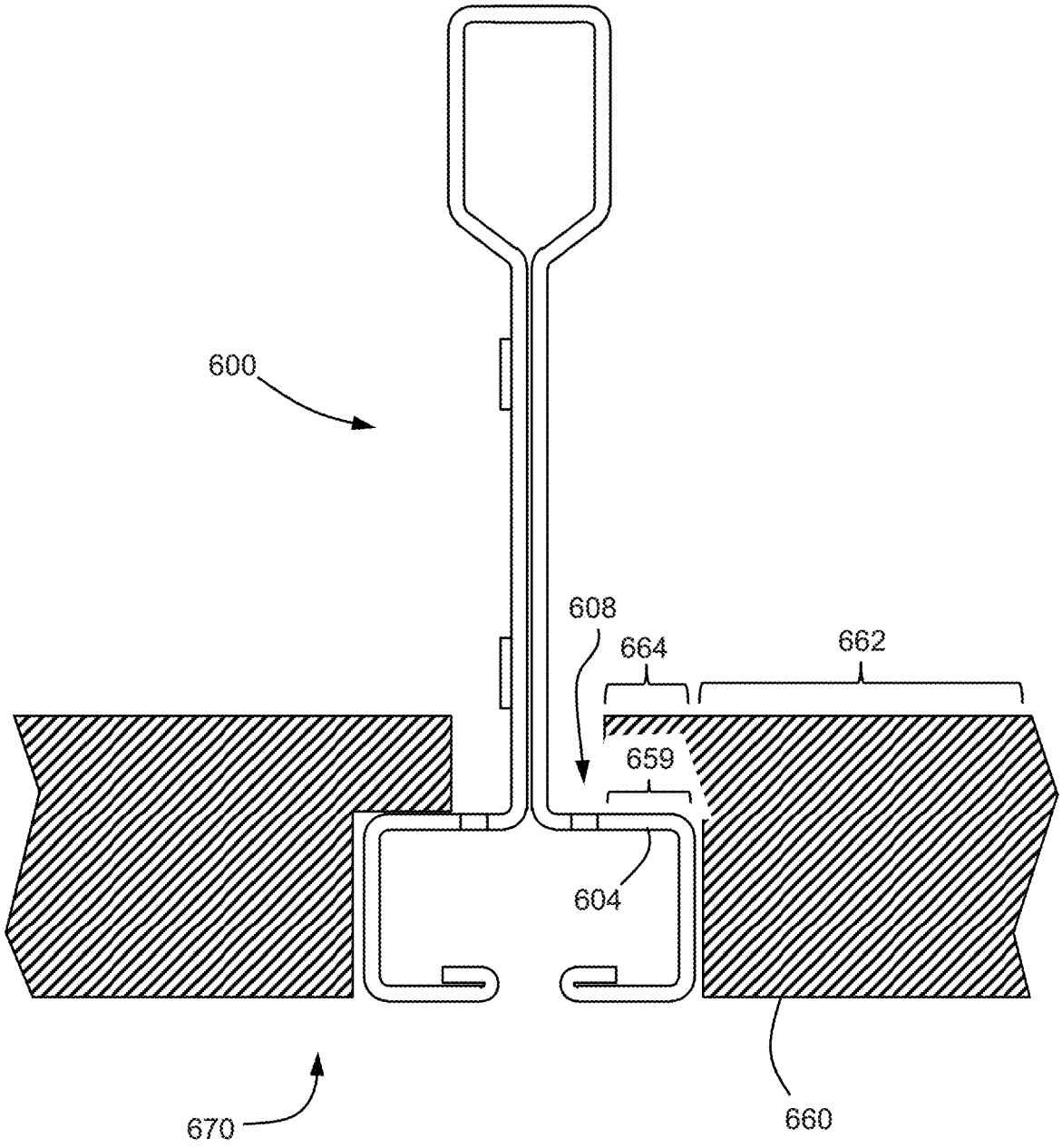
FIG. 7 is a detailed view of a single support beam and neighboring ceiling tiles of the suspension ceiling ventilation system of FIG. 6.

In certain embodiments as otherwise described herein, each of the flanges of the support beams includes a contact area, and the ceiling tiles are supported by the respective contact areas of the support beams. For example, as shown in the detailed view of FIG. 7, at least a portion of the flanges of support beams 652 provide a contact area disposed on a surface on an upper side of the flange for contacting a ceiling tile 660 that is placed in the neighboring grid opening 656. Accordingly the ceiling grid 654 provides support for ceiling tiles 660 that are placed in grid openings 656.

In certain embodiments as otherwise described herein, the contact area of the first flange of the vented support beam includes an outside portion of the first flange, and the vent through the first flange extends through an inside portion of the first flange. For example, vented support beam 600, as shown in the detailed view of FIG. 7, includes contact area 659 on an outside portion of first flange 604, while vent 608 is formed through the inside portion of first flange 604. Accordingly, when ceiling tile 660 is placed on contact area 659, vent 608 is unobstructed and air can flow therethrough.

The term outside portion, as used herein, refers to a portion that is at the lateral outer side of the support beam, i.e., a portion that is away from the horizontal center of the support beam. Likewise, means the inside portion is a portion that is nearer the horizontal center of the support beam.

In certain embodiments as otherwise described herein, each of the ceiling tiles includes a central body and a projection extending from an edge of the central body. Each of the projections is supported by a respective flange of an adjacent support beam. For example, as shown in the detailed view in FIG. 7, ceiling tile 660 includes a central body 662 and a projection 664 extending outward from an outer edge of the central body. The projection 664 allows ceiling tile 660 to be supported on first flange 604 while the lower end of vented support beam 600 and the lower surface of ceiling tile 660 are flush. The flush positioning of the support beam 600 and ceiling tile 660 provides an attractive continuous lower surface of the suspension ceiling 670. In other embodiments, the lower surface of the ceiling tile is flat, and the body of the ceiling tile is supported directly by the flange.

Figure 8:
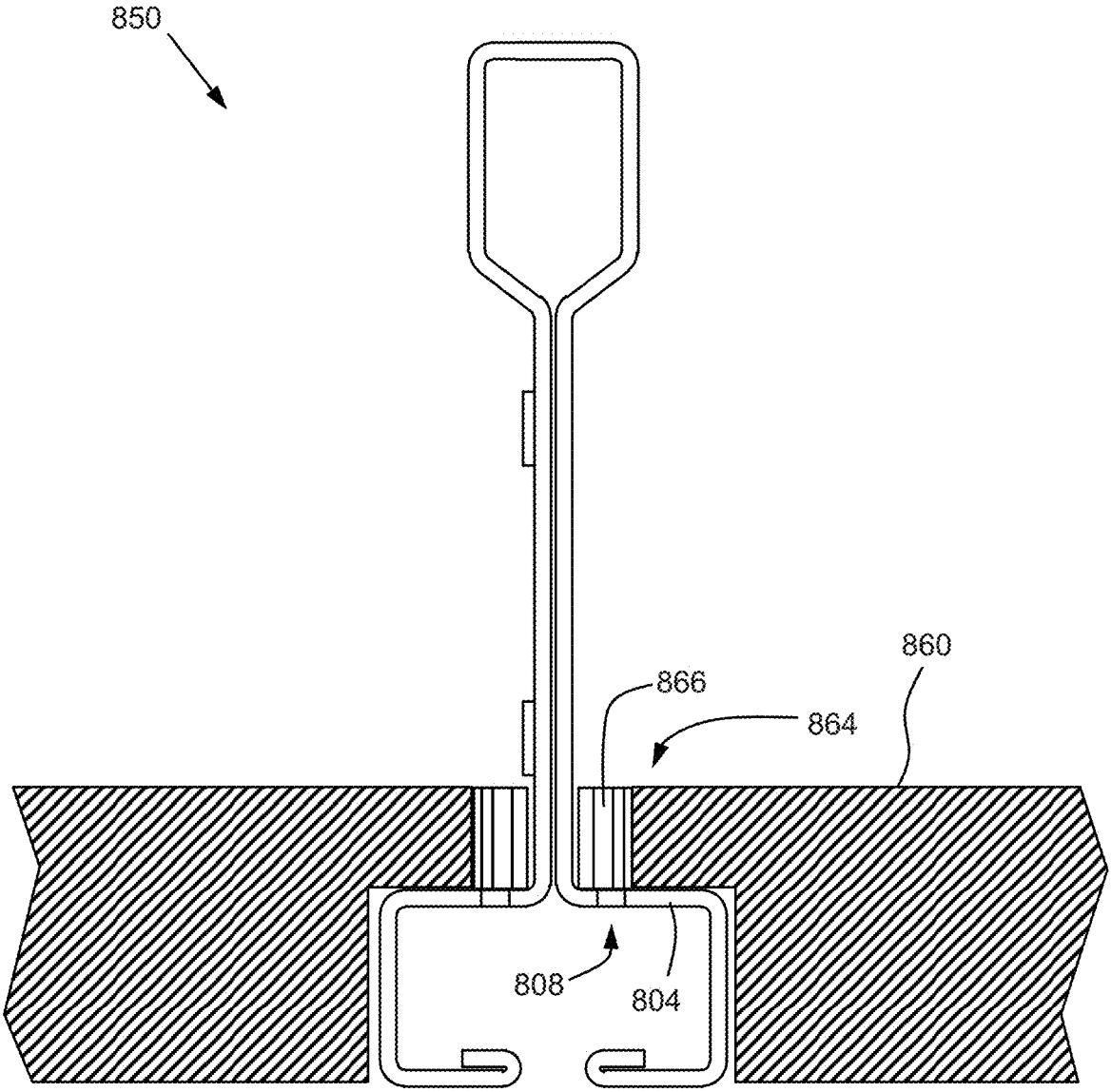
FIG. 8 is a detailed view of a single support beam and neighboring ceiling tiles of a suspension ceiling ventilation system according to another embodiment of the disclosure.

In certain embodiments as otherwise described herein, each of at least a portion of the ceiling tiles includes a notch that forms an opening in the respective ceiling tile to provide fluid access to the vent of a respective vented support beam. For example, in the detailed view of suspension ceiling ventilation system 850, shown in FIG. 8, portions of the projection 864 of ceiling tile 860 extend over the entire width of flange 804. However, to provide fluid access to vent 808, the ceiling tile, particularly the projection of the ceiling tile includes a notch 866 positioned over the hole forming vent 808. Accordingly, air can flow through notch 866 to reach vent 808.

Figure 9:
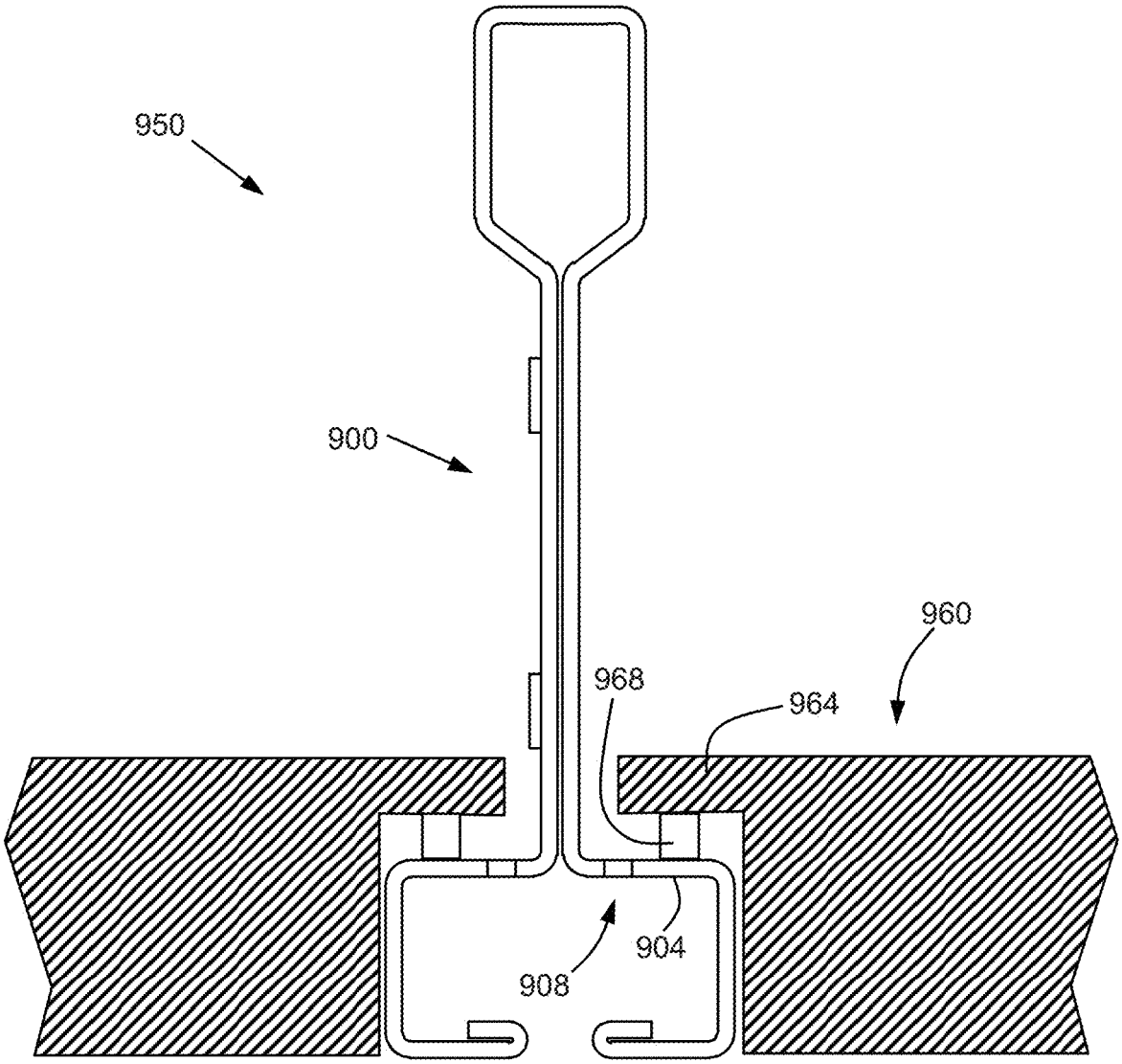
FIG. 9 is a detailed view of a single support beam and neighboring ceiling tiles of a suspension ceiling ventilation system according to yet another embodiment of the disclosure.

In certain embodiments as otherwise described herein, at least a portion of the ceiling tiles include a gasket disposed at an outer edge thereof, wherein the gasket contacts a respective flange of at least one of the support beams. For example, in suspension ceiling ventilation system 950, shown in FIG. 9, the ceiling tiles 960 each include a gasket 968 disposed between the projection 964 of ceiling tile 960 and the flange 904 of the vented support beam 900. In some embodiments, the gasket forms a seal between the ceiling tile and the support beam, which forces air through the vent instead of through any gap between the ceiling tile and the adjacent flange. Moreover, the use of the gasket allows the ceiling tile to be set back from the vent, which can improve air flow through the vent.

Figure 10:
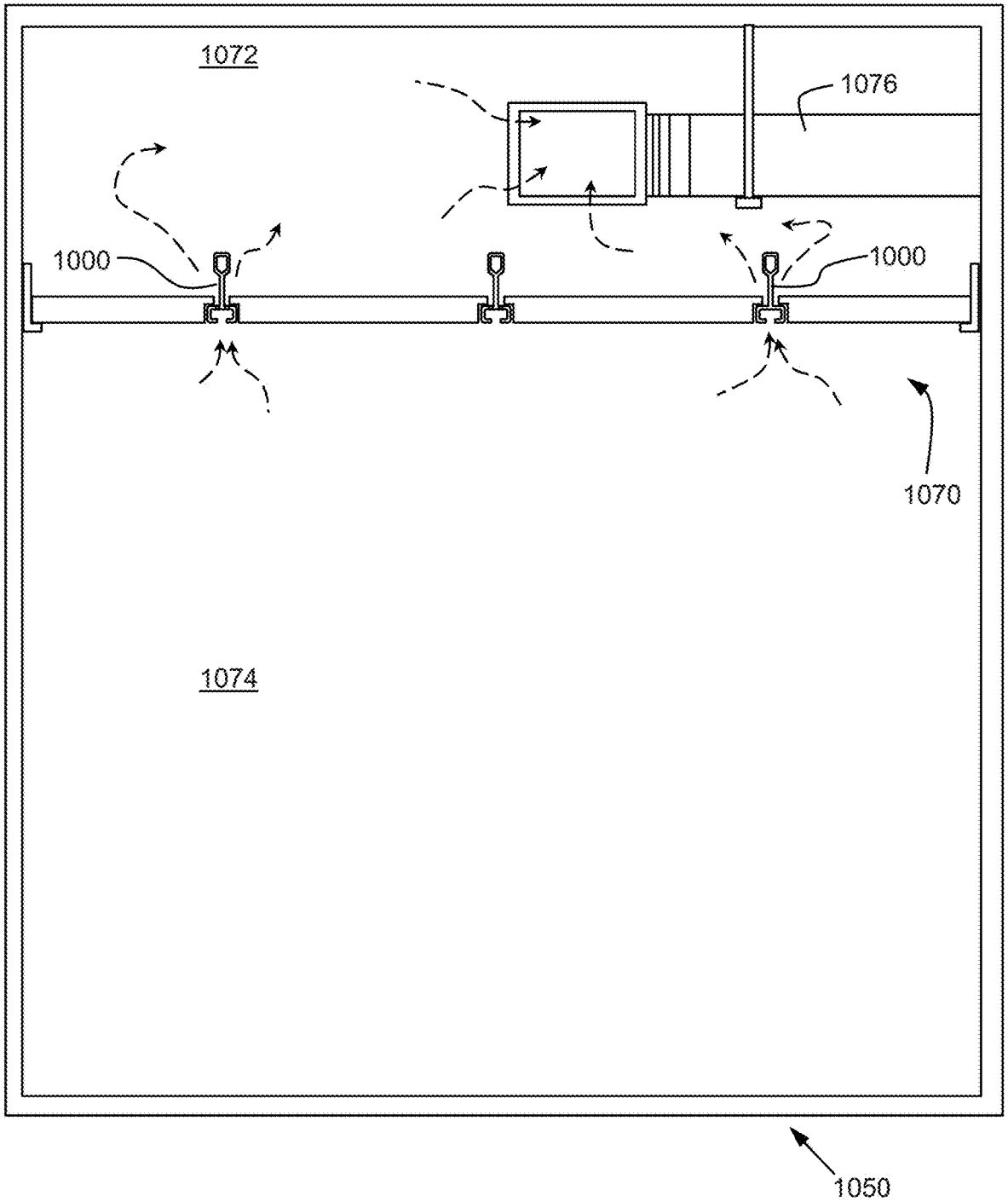
FIG. 10 is a schematic cross-sectional side view of a suspension ceiling ventilation system in accordance with an embodiment of the disclosure.

In certain embodiments as otherwise described herein, the plenum space has a first pressure and the underlying space has a second pressure that is different from the first pressure so as to force air through the respective vents of the vented support beams. In certain embodiments as otherwise described herein, the suspension ceiling ventilation system further includes a duct providing fluid communication between the plenum space and a compressor. For example, ventilation system 650 includes a duct 676 that extends into plenum space 672. Duct 676 is downstream of a compressor that forces air into plenum space 672 creating an elevated pressure therein. The elevated pressure in plenum space 672 forces air through the vented support beams 600 and into underlying space 674. In other embodiments, the duct is upstream of the compressor, which drives air out of the plenum space. For example, in ventilation system 1050, shown in FIG. 10, duct 1076 is connected to plenum space 1072 and is located upstream of a compressor that removes air from plenum space 1072. The compressor therefore creates a pressure drop in plenum space 1072 so that air flows from the underlying space 1074 through the vented support beams 1000 of suspension ceiling 1070 and into the plenum space 1072.

Figure 11:
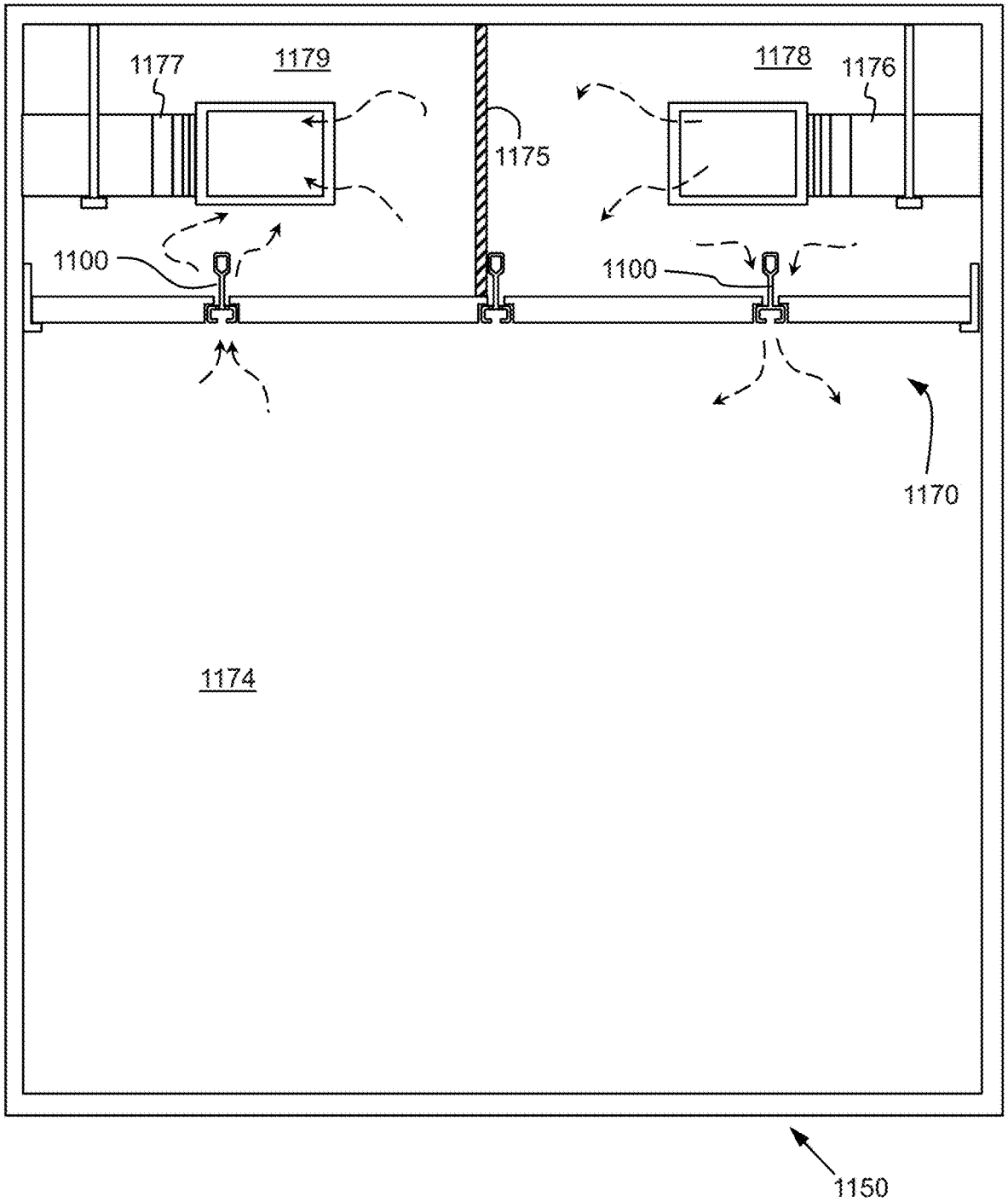
FIG. 11 is a schematic cross-sectional side view of a suspension ceiling ventilation system in accordance with an embodiment of the disclosure.

In certain embodiments as otherwise described herein, the suspension ceiling ventilation system includes a divider that separates a first section of the plenum space from a second section of the plenum space. Further, the first section of the plenum space has a first pressure, the second section of the plenum space has a second pressure and the underlying space has a third pressure that is between the first and second pressures so as to force air from the first section of the plenum space to the underlying space through respective vents of a first group of the vented support beams and to force air from the underlying space to the second section of the plenum space through respective vents of a second group of the vented support beams. For example, ventilation system 1150, shown in FIG. 11, includes a divider 1175 within the plenum space 1172 that divides the plenum space into a first section 1178 and a second section 1179. Likewise, a first duct 1176 extends into the first section 1178 of the plenum space 1172, and a second duct 1177 extends into the second section 1179 of the plenum space 1172. One or more compressors in fluid communication with the air ducts 1176, 1177 causes a pressure differential between the first section 1178 and second section 1179. The pressure differential between the two sections 1178, 1179 of the plenum space causes air to flow into the underlying space 1174 through the vented support beams 1100 that are adjacent to the first section of the plenum space. Likewise, the pressure differential further causes the air to flow from the underlying space 1174 into the second section 1179 of the plenum space through the associated vented support beams. Thus, the vented support beams 1100 of the suspension ceiling 1170 provide both the air supply and return for the underlying space 1174. The divider 1175 in ventilation system 1150 is attached to a support beam of the suspension ceiling. In other embodiments, the divider may be integrally formed with one of the support beams. Alternatively, the divider may divide the plenum space in other ways as will be appreciated by those of ordinary skill in the art.

In certain embodiments as otherwise described herein, a first portion of the support beams extend in a first direction and a second portion of the support beams extend in a second direction, where the first direction is at an angle to the second direction. For example, ceiling 1270, shown in FIG. 12 includes a ceiling grid 1254 with a plurality of support beams running perpendicular to one another. A first portion of the support beams run along the length of the ceiling 1270 and a second portion run across the width of the ceiling.

In certain embodiments as otherwise described herein, the first portion of support beams includes main runners that span a plurality of the grid openings of the ceiling grid, and the second portion of support beams includes cross beams that extend from a respective one of the main runners to a neighboring main runner. For example, ceiling grid 1254 includes main runners 1280 that run along the entire length of ceiling 1270 and span six grid openings 1256 and the corresponding ceiling tiles 1260. While the main runners in ceiling 1270 span the entire length of the ceiling, in other embodiments, the main runners extend across multiple openings but span only a fraction of the ceiling. Cross beams 1282 extend between neighboring pairs of main runners 1280. Together, a group of cross beams 1282 spans the width of ceiling 1270. In other embodiments, the main runners extend across the width of the ceiling while the cross beams extend across the length.

In certain embodiments as otherwise described herein, a first portion of the cross beams are vented support beams and a second portion of the cross beams are unvented support beams. For example, in ceiling 1270, there are four rows of cross beams 1282. Two of the rows are entirely formed with cross beams 1282 taking the form of vented support beams 1200. The other two rows include both cross beams 1282 in the form of vented support beams 1200 and unvented support beams 1258. In certain embodiments, the fraction of the ceiling grid that is formed by vented support beams impacts the flow of air between the plenum space and the underlying space. Because of the large number of cross beams 1282, the using cross beams that are both vented and unvented allows a builder to select a precise percentage of the grid that is formed with vented support beams, which allows fine tuning of the flow rate between the plenum space and underlying space. While the main runners 1280 in ceiling 1270 are unvented, in other embodiments, the main runners are vented. Still in other embodiments a portion of the main runners are vented and a portion are unvented.

In certain embodiments as otherwise described herein, the grid forms edge openings along at least one perimeter edge of the suspension ceiling, and the suspension ceiling ventilation system further comprises ceiling tile sections disposed in the edge openings. For example, the openings 1284 around the perimeter of ceiling 1270 are smaller than the grid openings 1256 in the center of the ceiling. To form a continuous surface across the ceiling, a section of ceiling tile 1286 is positioned in each of the edge openings 1284.

While the vented ceiling grid allows for fewer interruptions in the ceiling surface, in some embodiments the ceiling includes features that interrupt the ceiling tiles of the suspension ceiling. For example, in some embodiments the ceiling includes lighting fixtures and emergency components, such as sprinklers. In some embodiments, the ceiling includes one or more diffusers that cooperate with the vented ceiling grid.

In another aspect, the disclosure provides a method of constructing a suspension ceiling ventilation system according to any of the embodiments described above. The method includes arranging a plurality of support beams in a ceiling grid that is coupled to a support structure, where the ceiling grid includes a plurality of grid openings between the support beams. Each of the support beams includes a vertical web and opposing flanges protruding laterally from the vertical web, wherein at least a portion of the plurality of support beams are vented support beams. The method further includes positioning each of a plurality of ceiling tiles in a respective grid opening of the ceiling grid so as to form a suspension ceiling, where the suspension ceiling provides a plenum space above the ceiling and an underlying space below the ceiling.

Figure 12:
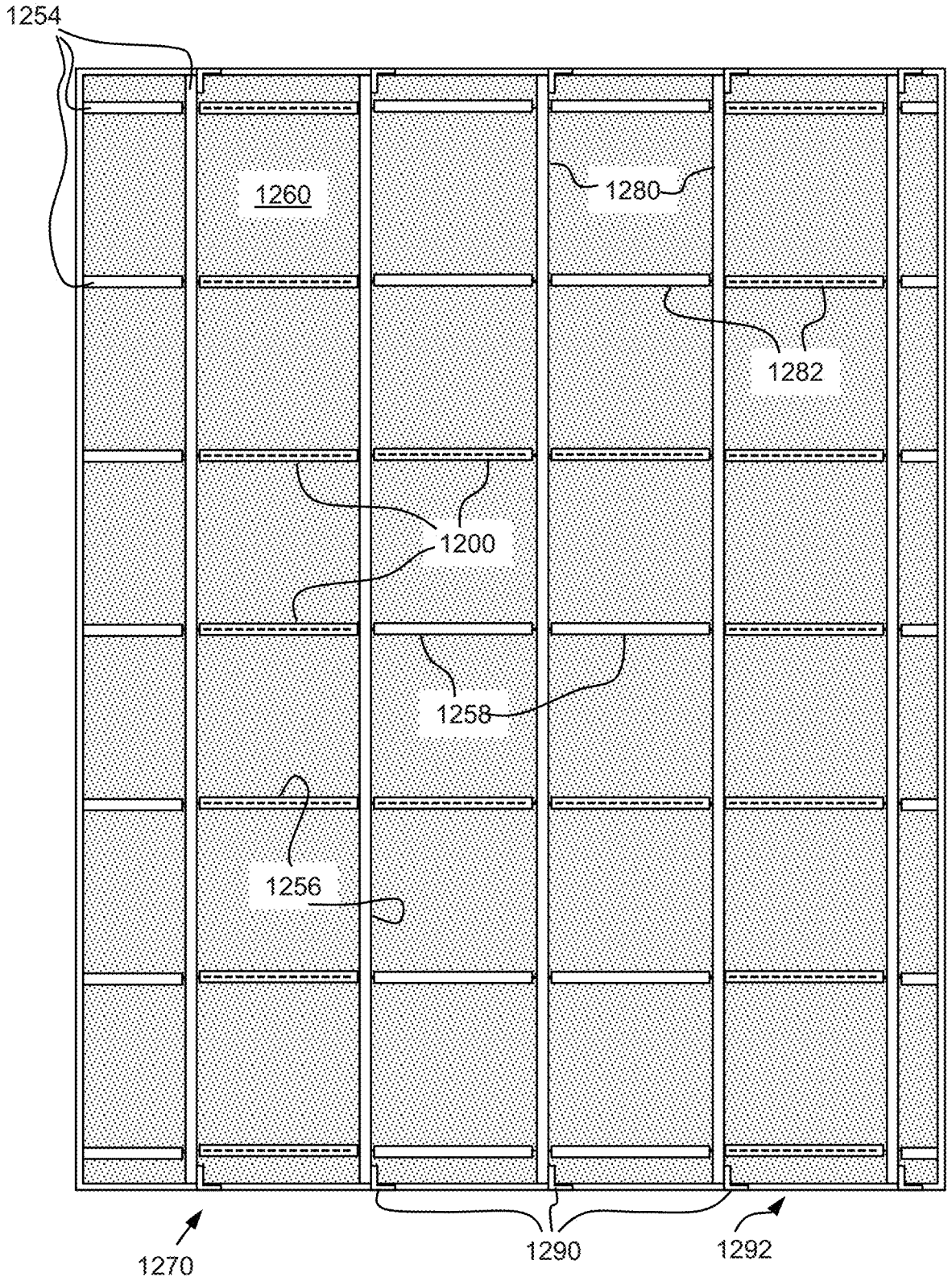
FIG. 12 is a schematic top view of a suspension ceiling in accordance with another embodiment of the disclosure.

For example, ceiling 1270 of FIG. 12 includes a ceiling grid 1254 that is coupled by brackets 1290 to a wall 1292 disposed around the perimeter of ceiling 1270. For example, in some embodiments each of the beams at the outer perimeter of ceiling grid 1254 is attached to a respective bracket 1290 using mechanical fasteners which are, in turn, attached to the wall 1292. The ceiling grid 1254, once assembled, forms a plurality of grid openings 1256 and edge openings 1284. To complete the ceiling 1270, ceiling tiles 1260 are inserted into the grid openings 1256 and ceiling tile sections are inserted into the edge openings 1284. At least a portion of the support beams take the form of vented support beams 1200.

In certain embodiments as otherwise described herein, the method further includes providing a notch at an outer edge of at least one of the plurality of ceiling tiles so as to form an opening in the respective ceiling tile to provide fluid access to the vent of a respective vented support beam. For example, in some embodiments, a notch, such as notch 866 shown in suspension ceiling ventilation system 850, is added to the ceiling tile at installation. For example, in some embodiments, the builder removes the notch before placing the ceiling tile on the flange of a respective beam. In some embodiments an area corresponding to the notch is perforated to allow for easy removal of the notch during installation. In other embodiments, the notch is formed at the manufacturing cite.

In certain embodiments as otherwise described herein, the method further includes coupling a duct to the plenum space, where the duct is in fluid communication with a compressor, and operating the compressor so as to provide a pressure differential between the plenum space and the underlying space so as to force air through the respective vents of the vented support beams. For example, as explained above, in system 650 a compressor is in fluid communication with duct 676 and is operated to force air into plenum space 672. This forced air then creates an increase in pressure, which forces air through the vented support beams 600 into underlying space 674.

In certain embodiments as otherwise described herein, a first portion of the support beams extend in a first direction and a second portion of the support beams extend in a second direction, and wherein the first direction is at an angle to the second direction. For example, in the installation of ceiling 1270, the main runners 1280 of the ceiling grid 1254 are arranged to extend in the length direction. In contrast, the cross beams 1282 are arranged to extend in the width direction, at 90 degrees from the main runners 1280.

In certain embodiments as otherwise described herein, the method further includes selecting the number of vented support beams in the ceiling grid based on a desired air flow rate between the plenum space and the underlying space. For example, as explained above, in certain embodiments, a portion of the ceiling grid is formed by vented support beams and a portion is formed by unvented support beams.

Due to the extent of beams in the grid, the builder can choose the ratio of the grid that is formed by vented support beams in order to control the flow rate between the plenum space and the underlying space.

EXAMPLE

Figure 13:
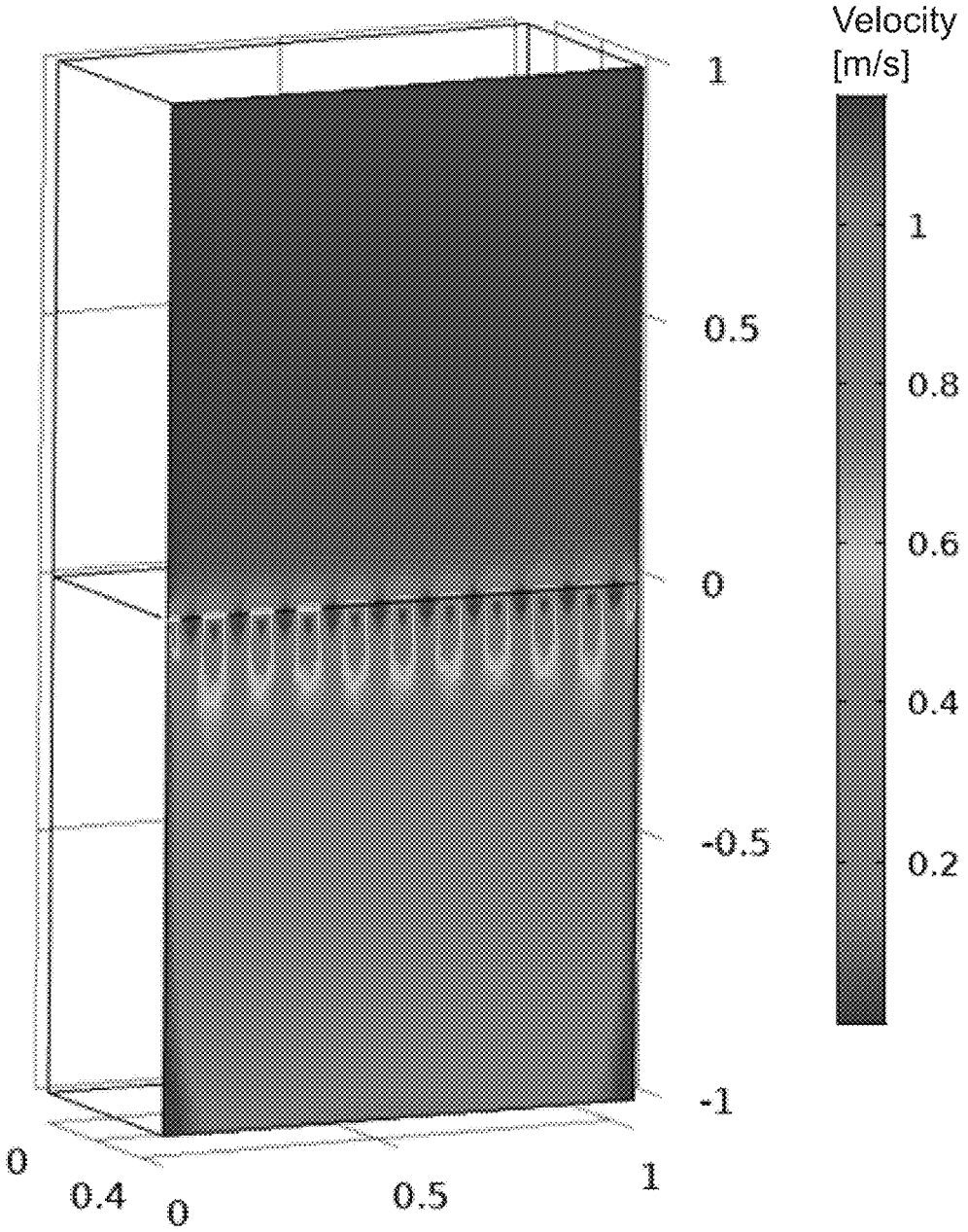
FIG. 13 illustrates the air flow through a vented support beam in accordance with an embodiment of the disclosure in an example ceiling construction.

FIG. 13 illustrates the air flow through a vented support beam in accordance with an embodiment of the disclosure in an example ceiling construction. The example includes a room having 8' high ceilings with a ceiling area of 28'×16'. The room is configured to have five air changes per hour, which corresponds to an air flow of 300 CFM. The ceiling grid is formed of 672 feet of vented support beams including rows of circular holes having a diameter of 0.050" and spaced at 0.100" center-to-center, providing a total of 153,216 holes in the vented grid. Based on the total air flow and the number of holes, the air flow per hole was determined to be 0.00195 CFM, with an average air speed of 0.73 m/s.

The pressure drop between the plenum space and the underlying space that is needed to achieve the desired flow rate can be calculated based on the above figures using equations for minor head loss. Minor head loss is expressed as multiples of the velocity head, where K is the loss coefficient, and minor head loss can be used to solve for velocity as shown in equation (1).

$$h_m = Kh_v = K\frac{u^2}{2g} \rightarrow u = \sqrt{\frac{2gh_m}{K}} \tag{1}$$

The volumetric flow rate through an orifice is given by equation (2), where $C_d$, the discharge coefficient, is related to the loss coefficient as $$C_d = \frac{1}{\sqrt{K}},$$

u is the average velocity through the orifice, and A is the cross-sectional area of the orifice.

$$Q=uA=C_dA\sqrt{2gh_m} \tag{2}$$

Further, minor head loss is also related to pressure drop, as shown in equation (3), where ρ is density, and $g_c$ is the conversion factor for U.S. customary units. Combining equations (2) and (3) allows the pressure drop to be calculated based on volumetric flow rate Q, hole diameter d and the loss coefficient $C_d$.

$$h_m = \frac{\Delta p}{\rho g} \tag{3}$$

$$Q = C_d\frac{\pi}{4}d^2\sqrt{2g\frac{\Delta p}{\rho g}} \rightarrow \Delta p = \frac{\rho Q^2}{2C_d^2\left(\frac{\pi}{4}\right)^2 d^4 g_c} \tag{4}$$

Based on the foregoing calculations, the pressure drop needed to achieve the volume flow rate of 300 CFM in the example ceiling construction is 0.87 Pa, or 0.00013 psi. Finite element calculations agreed with the foregoing calculation based on the handbook value of Cd. One skilled in the art will appreciate that the above is but a single example, and that the size and number of the holes and perforations can be varied to fit the air volumes and air speeds required for a wide variety of spaces, all of which would be derivable from the provided equations. Similarly, it is recognized in the art that while there are design minimums and design targets, the required volumes of air exchanged may be increased above such minimums and targets for a variety of reasons, including occupant comfort or efficiency of compressor or system operation.

Additional aspects of the disclosure are provided by the following numbered embodiments, which can be combined and permuted in any number and in any fashion that is not logically or technically inconsistent.

Embodiment 1

A vented support beam for a suspension ceiling comprising:

an elongate body extending in a longitudinal direction, the body including:

a vertical web, and opposing first and second flanges protruding laterally from the vertical web; and a vent formed through the first flange.

Embodiment 2

The vented support beam according to embodiment 1, further comprising another vent formed through the second flange.

Embodiment 3

The vented support beam according to any of embodiment 1 or embodiment 2, wherein a width of the beam is in a range from ¼ inch to 2 inches, e.g., from ⅜ to 1½ inches, e.g., from ½ inch to 1 inch.

Embodiment 4

The vented suspension ceiling support beam according to any of embodiments 1 to 3, wherein a height of the beam is in a range from 1 inch to 3 inches, e.g., from 1½ inches to 2 inches.

Embodiment 5

The vented support beam according to any of embodiments 1 to 4, wherein the vent extends at least 6 inches in the longitudinal direction, e.g., at least 12 inches, e.g., at least 20 inches.

Embodiment 6

The vented support beam according to any of embodiments 1 to 5, wherein the vent includes a plurality of holes disposed in a line along the longitudinal direction.

Embodiment 7

The vented support beam according to any of embodiments 1 to 6, wherein the vent includes a slot extending along the longitudinal direction.

Embodiment 8

The vented support beam according to any of embodiments 1 to 7, further comprising a channel disposed adjacent to the first and second flanges, wherein the channel is in fluid communication with the vent.

Embodiment 9

The vented support beam according to embodiment 8, wherein the channel is formed by a first side wall projecting down from an outer edge of the first flange and a second side wall projecting down from an outer edge of the second flange.

Embodiment 10

The vented support beam according to embodiment 8 or embodiment 9, wherein the channel is enclosed in a box profile disposed below the first and second flanges.

Embodiment 11

The vented support beam according to embodiment 10, wherein the box profile includes a slot opposite the first and second flanges, wherein the slot extends in the longitudinal direction.

Embodiment 12

The vented support beam according to embodiment 11, wherein the box profile includes a first sidewall, a second sidewall, a first lip connected to the first sidewall that borders the slot, and a second lip connected to the second sidewall that borders the slot.

Embodiment 13

The vented support beam according to any of embodiments 1 to 12, wherein the web includes adjacent first and second support walls, and wherein the vent is disposed laterally outside of the first and second support walls.

Embodiment 14

The vented support beam according to embodiment 13, wherein an inner surface of the first support wall abuts an inner surface of the second support wall.

Embodiment 15

The vented support beam according to any of embodiments 1 to 14, further comprising a bulb attached to an upper end of the web, and wherein the first and second flanges are disposed at a lower end of the web.

Embodiment 16

A suspension ceiling ventilation system comprising:

a plurality of support beams arranged in a ceiling grid so as to form a plurality of grid openings in the ceiling grid, each of the support beams including a vertical web and opposing flanges protruding laterally from the vertical web, wherein at least a portion of the plurality of support beams are vented support beams according to any of embodiments 1 to 13;

a plurality of ceiling tiles, each of the ceiling tiles disposed in a respective grid opening of the ceiling grid so as to form a suspension ceiling, wherein the suspension ceiling provides a plenum space above the ceiling and an underlying space below the ceiling.

Embodiment 17

The suspension ceiling ventilation system according to embodiment 16, wherein each of the flanges of the support beams includes a contact area, and wherein the ceiling tiles are supported by the respective contact areas of the support beams.

Embodiment 18

The suspension ceiling ventilation system according to embodiment 17, wherein the contact area of the first flange of the vented support beam includes an outside portion of the first flange, and wherein the vent through the first flange extends through an inside portion of the first flange.

Embodiment 19

The suspension ceiling ventilation system according to any of embodiments 16 to 18, wherein each of the ceiling tiles includes a central body and a projection extending from an edge of the central body, wherein each of the projections is supported by a respective flange of an adjacent support beam.

Embodiment 20

The suspension ceiling ventilation system according to any of embodiments 16 to 19, wherein each of at least a portion of the ceiling tiles include a notch that forms an opening in the respective ceiling tile to provide fluid access to the vent of a respective vented support beam.

Embodiment 21

The suspension ceiling ventilation system according to any of embodiments 16 to 20, wherein each of at least a portion of the ceiling tiles include a gasket disposed at an outer edge thereof, wherein the gasket contacts a respective flange of at least one of the support beams.

Embodiment 22

The suspension ceiling ventilation system according to any of embodiments 16 to 21, wherein the plenum space has a first pressure and the underlying space has a second pressure that is different from the first pressure so as to force air through the respective vents of the vented support beams.

Embodiment 23

The suspension ceiling ventilation system according to embodiment 22, further comprising a duct providing fluid communication between the plenum space and a compressor.

Embodiment 24

The suspension ceiling ventilation system according to any of embodiments 16 to 21, further comprising a divider that separates a first section of the plenum space from a second section of the plenum space, wherein the first section of the first section of the plenum space has a first pressure, the second section of the plenum space has a second pressure, and the underlying space has a third pressure that is between the first and second pressures so as to force air from the first section of the plenum space to the underlying space through respective vents of a first group of the vented support beams and to force air from the underlying space to the second section of the plenum space through respective vents of a second group of the vented support beams.

Embodiment 25

The suspension ceiling ventilation system according to any of embodiments 16 to 24, wherein a first portion of the support beams extend in a first direction and a second portion of the support beams extend in a second direction, and wherein the first direction is at an angle to the second direction.

Embodiment 26

The suspension ceiling ventilation system according to embodiment 25, wherein the first portion of support beams includes main runners that span a plurality of the grid openings of the ceiling grid, and wherein the second portion of support beams includes cross beams that extend from a respective one of the main runners to a neighboring main runner.

Embodiment 27

The suspension ceiling ventilation system according to embodiment 26, wherein a first portion of the cross beams are vented support beams and a second portion of the cross beams are unvented support beams.

Embodiment 28

The suspension ceiling ventilation system according to any of embodiments 16 to 27, wherein the grid forms edge openings along at least one perimeter edge of the suspension ceiling, and wherein the suspension ceiling ventilation system further comprises ceiling tile sections disposed in the edge openings.

Embodiment 29

A method of constructing a suspension ceiling ventilation system according to any of embodiments 16 to 28, the method comprising:

arranging a plurality of support beams in a ceiling grid that is coupled to a support structure, wherein the ceiling grid includes a plurality of grid openings between the support beams, each of the support beams including a vertical web and opposing flanges protruding laterally from the vertical web, wherein at least a portion of the plurality of support beams are vented support beams;

positioning each of a plurality of ceiling tiles in a respective grid opening of the ceiling grid so as to form a suspension ceiling, wherein the suspension ceiling provides a plenum space above the ceiling and an underlying space below the ceiling.

Embodiment 30

The method according to embodiment 29, further comprising providing a notch at an outer edge of at least one of the plurality of ceiling tiles so as to form an opening in the respective ceiling tile to provide fluid access to the vent of a respective vented support beam.

Embodiment 31

The method according to embodiment 29 or embodiment 30, further comprising coupling a duct to the plenum space, wherein the duct is in fluid communication with a compressor, and operating the compressor so as to provide a pressure differential between the plenum space and the underlying space so as to force air through the respective vents of the vented support beams.

Embodiment 32

The method according to any of embodiments 29 to 31, wherein a first portion of the support beams extend in a first direction and a second portion of the support beams extend in a second direction, and wherein the first direction is at an angle to the second direction.

Embodiment 33

The method according to any of embodiments 29 to 32, further comprising selecting the number of vented support beams in the ceiling grid based on a desired air flow rate between the plenum space and the underlying space.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A suspension ceiling ventilation system comprising:

a plurality of support beams arranged in a ceiling grid so as to form a plurality of grid openings in the ceiling grid, each of the support beams comprising an elongate body extending in a longitudinal direction, the body including a vertical web and opposing first and second flanges protruding laterally from the vertical web, wherein at least a portion of the plurality of support beams are vented support beams, each of the vented support beams including a vent formed through the respective first flange thereof and a channel disposed adjacent to the first and second flanges that is in fluid communication with the vent, wherein the channel is formed by a first side wall projecting down from an outer edge of the first flange and a second side wall projecting down from an outer edge of the second flange, and wherein the channel is enclosed in a box profile disposed below the first and second flanges that includes a slot opposite the first and second flanges;

a plurality of ceiling tiles, each of the ceiling tiles disposed in a respective grid opening of the ceiling grid so as to form a suspension ceiling, each of the ceiling tiles including a central body and a projection extending from an edge of the central body, wherein each of the projections is supported by a respective flange of an adjacent support beam such that a lower surface of the respective ceiling tile is flush with a lower end of the box profile of the adjacent support beam, wherein the suspension ceiling provides a plenum space above the ceiling and an underlying space below the ceiling.

2. The suspension ceiling ventilation system according to claim 1, wherein each of the flanges of the support beams includes a contact area, and wherein the ceiling tiles are supported by the respective contact areas of the support beams.

3. The suspension ceiling ventilation system according to claim 1, wherein the contact area of the first flange of the vented support beam includes an outside portion of the first flange, and wherein the vent through the first flange extends through an inside portion of the first flange.

4. The suspension ceiling ventilation system according to claim 1, wherein each of at least a portion of the ceiling tiles include a gasket disposed at an outer edge thereof, wherein the gasket contacts a respective flange of at least one of the support beams.

5. The suspension ceiling ventilation system according to claim 1, wherein the plenum space has a first pressure and the underlying space has a second pressure that is different from the first pressure so as to force air through the respective vents of the vented support beams.

6. The suspension ceiling ventilation system according to claim 5, further comprising a duct providing fluid communication between the plenum space and a compressor.

7. The suspension ceiling ventilation system according to claim 1, wherein each of the vented support beams further comprises another vent formed through the second flange.

8. The suspension ceiling ventilation system according to claim 1, wherein in each of the vented support beams the vent extends at least 6 inches in the longitudinal direction.

9. The suspension ceiling ventilation system according to claim 1, wherein in each of the vented support beams the vent includes a plurality of holes disposed in a line along the longitudinal direction.

10. The suspension ceiling ventilation system according to claim 1, wherein the slot extends in the longitudinal direction.

11. The suspension ceiling ventilation system according to claim 1, wherein in each of the vented support beams the web includes adjacent first and second support walls, and the vent is disposed laterally outside of the first and second support walls.

12. The suspension ceiling ventilation system according to claim 11, wherein in each of the vented support beams an inner surface of the first support wall abuts an inner surface of the second support wall.

13. A suspension ceiling ventilation system comprising:

a plurality of support beams arranged in a ceiling grid so as to form a plurality of grid openings in the ceiling grid, each of the support beams comprising an elongate body extending in a longitudinal direction, the body including a vertical web and opposing first and second flanges protruding laterally from the vertical web, wherein at least a portion of the plurality of support beams are vented support beams, each of the vented support beams including a vent formed through the respective first flange thereof;

a plurality of ceiling tiles, each of the ceiling tiles disposed in a respective grid opening of the ceiling grid so as to form a suspension ceiling, wherein the suspension ceiling provides a plenum space above the ceiling and an underlying space below the ceiling; and a divider that separates a first section of the plenum space from a second section of the plenum space, wherein the first section of the plenum space has a first pressure, the second section of the plenum space has a second pressure, and the underlying space has a third pressure that is between the first and second pressures so as to force air from the first section of the plenum space to the underlying space through respective vents of a first group of the vented support beams and to force air from the underlying space to the second section of the plenum space through respective vents of a second group of the vented support beams.

14. The suspension ceiling ventilation system according to claim 13, wherein the divider is attached to one of the plurality of support beams.

15. The suspension ceiling ventilation system according to claim 13, wherein the divider is integrally formed with one of the plurality of support beams.

16. The suspension ceiling ventilation system according to claim 13, wherein each of the vented support beams further comprises a channel disposed adjacent to the first and second flanges, wherein the channel is in fluid communication with the vent.

17. The suspension ceiling ventilation system according to claim 16, wherein in each of the vented support beams the channel is formed by a first side wall projecting down from an outer edge of the first flange and a second side wall projecting down from an outer edge of the second flange.

* * * * *